US005573482A

United States Patent [19]

Wang et al.

[11] Patent Number: 5,573,482

[45] Date of Patent: Nov. 12, 1996

[54] EXERCISING APPARATUS

[75] Inventors: Leao Wang; Peter Wu, both of Taichung Hsien, Taiwan

[73] Assignee: Greenmaster Industrial Corp., Taichung Hsien, Taiwan

[21] Appl. No.: 494,520

[22] Filed: Jun. 26, 1995

[51] Int. Cl.[6] ..... A63B 69/06

[52] U.S. Cl. ..... 482/96; 482/95; 482/72; 482/57

[58] Field of Search ..... 482/57, 95, 70, 482/96, 72, 51, 106, 110, 111

[56] References Cited

U.S. PATENT DOCUMENTS

| | | | |
|---|---|---|---|
| 2,642,288 | 6/1953 | Bell | 482/94 |
| 5,156,650 | 10/1992 | Bals | 482/95 |
| 5,299,997 | 4/1994 | Chen | 482/96 |
| 5,356,357 | 10/1994 | Wang et al. | 482/96 |
| 5,464,378 | 11/1995 | Yu | 482/95 |

*Primary Examiner*—Jerome Donnelly
*Attorney, Agent, or Firm*—Bacon & Thomas

[57] ABSTRACT

Enhanced body movements and optimum exercising effects are realized in a riding type exercising apparatus which includes separated hand drive and leg drive mechanisms, wherein the hand drive mechanism is located behind the body of the user so that when the user pulls on handles of the hand drive mechanism and pushes pedals of the leg drive mechanism, the handles travel an arcuate path about a pivot point at the hand drive mechanism so that the handles are disposed at a final point that is higher than their starting point. Simultaneously, a seat supporting the user is caused to move forwardly and upwardly in the opposite direction of the handles to prevent unrestricted large arm movements by the user.

4 Claims, 6 Drawing Sheets

EXERCISING APPARATUS

BACKGROUND OF THE INVENTION (a) Field of the Invention

The present invention relates generally to a riding type exercising apparatus, and more particularly to an exercising apparatus in which a hand drive mechanism and a leg drive mechanism are separated to position the hand drive mechanism behind the user's body so that a comparatively longer travel may be generated when both handles of the hand drive mechanism are pulled, thus enhancing the exercising effects and comfort in using such type of exercising apparatus.

(b) Description of the Prior Art

The riding type exercising apparatus is a new kind of indoor exercising apparatus which is currently quite popular. Such exercising apparatus utilizes the weight of the user as a source of resistance to provide convenient exercising effects. This is the reason why they are popular.

There are, however, a number of disadvantages in these apparatuses, which will hereinafter be described with reference to three known apparatuses of this type.

With reference to FIGS. 1, 2 and 3 which show three different known riding type exercising apparatuses, it can be seen that all three commonly have a main action bar A having a rotary pivot axle B provided in front and below a seat portion C. Under normal circumstances, handles D are located at a higher point relative to the rotary pivot axle B. When the user is seated on the seat portion C and grips the handles D to pull the main action bar A towards the body, an auxiliary action bar E located at a lower position relative to the rotary pivot axle B will, through a link F, push the seat portion C gradually upward to a final point. However, since the handles D are located at a higher point relative to the rotary pivot axle B, when the handles undergo an arcuate displacement with axle B as the center of the circle, their final point will be lower than their starting point. In other words, the seat portion C rises gradually upwardly while the handles D descend to a small extent, so the seat portion C and the handles D approach each other.

This kind of apparatus operation does not provide optimum exercising posture and smoothness because there is no obvious change in the positions of the user's hands prior to pulling the handles D and after the final point is reached since the elevation between the seat portion C and the handles D becomes restricted due to the rise of the seat portion C and the slight drop of the handles D. In other words, when the user utilizes this kind of exercising apparatus, the hands of the user are merely performing linear pulling and extending movements in front of the user's abdomen and is restricted from performing large arm swinging or expanding movements. Thus, the exercising effects provided thereby cannot be compared with other kinds of indoor exercising apparatuses.

Furthermore, when the user's arms are located at a final point of movement, both arms are in a substantially bent position and press against the user's abdomen, so such a posture is not only uncomfortable but the user may accidentally bump the abdomen.

SUMMARY OF THE INVENTION

A primary object of the present invention is to provide an exercising apparatus in which the user may have a larger space for movement of the hands and may smoothly perform arm stretching, pulling and expanding movements in a natural posture in order to enhance exercising effects and provide overall comfort during exercising.

BRIEF DESCRIPTION OF THE DRAWINGS

The foregoing and other features and advantages of the present invention will be more dearly understood from the following detailed description and the accompanying drawings, in which.

DETAILED DESCRIPTION OF THE PREFERRED EMBODIMENT

Figure 1:
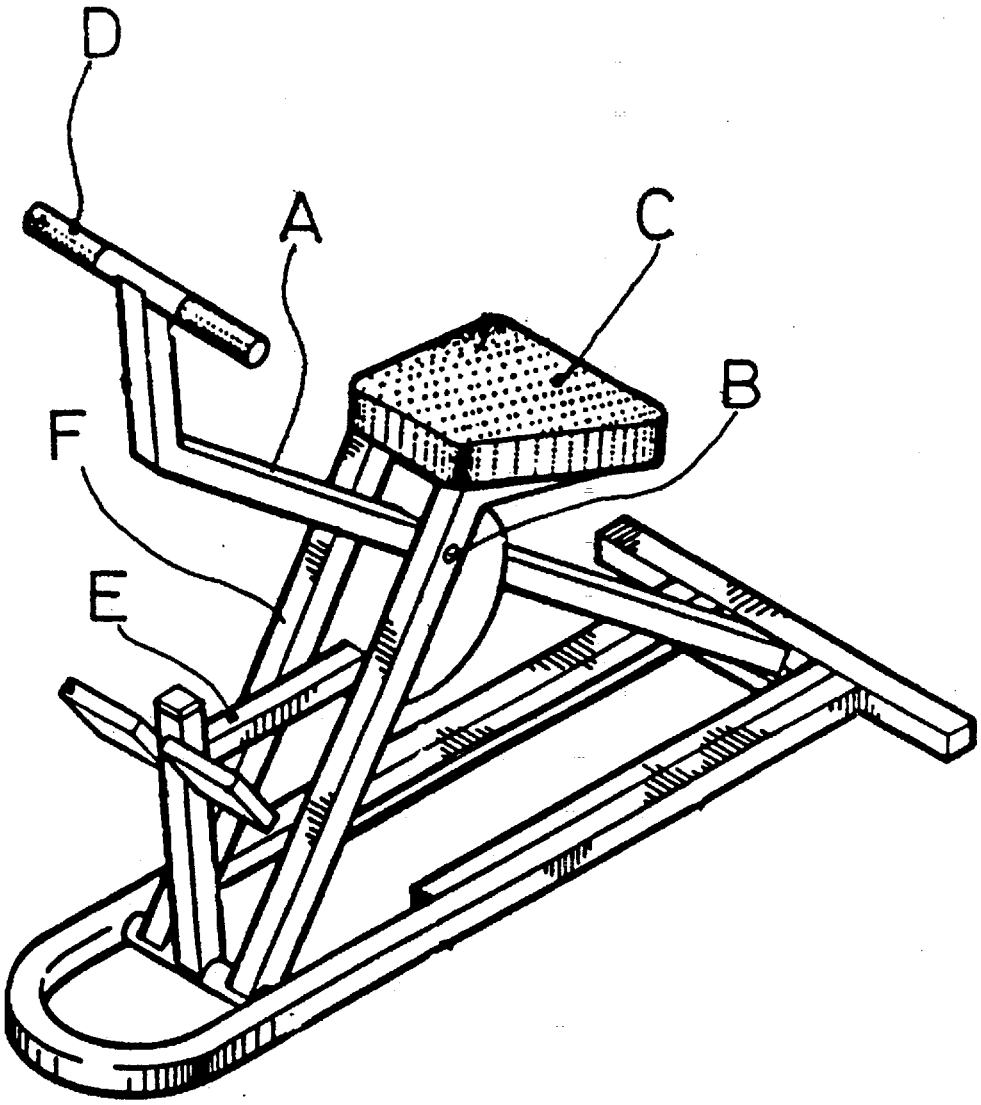
PRIOR ART FIG. 1
FIG. 1 is a side view of a first conventional riding type exercising apparatus.
Figure 2:
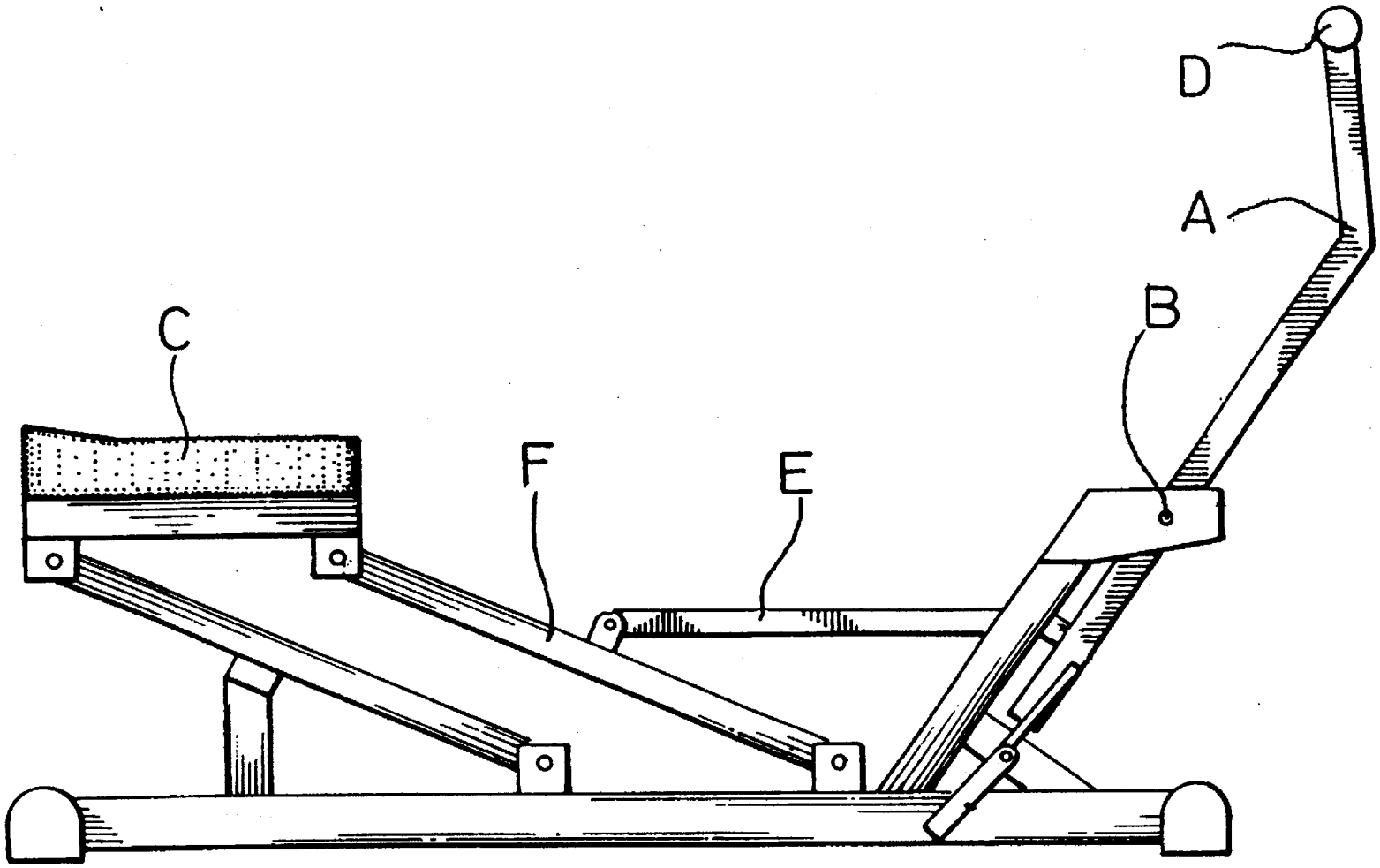
PRIOR ART FIG. 2
FIG. 2 is a perspective view of a second conventional riding type exercising apparatus.
Figure 3:
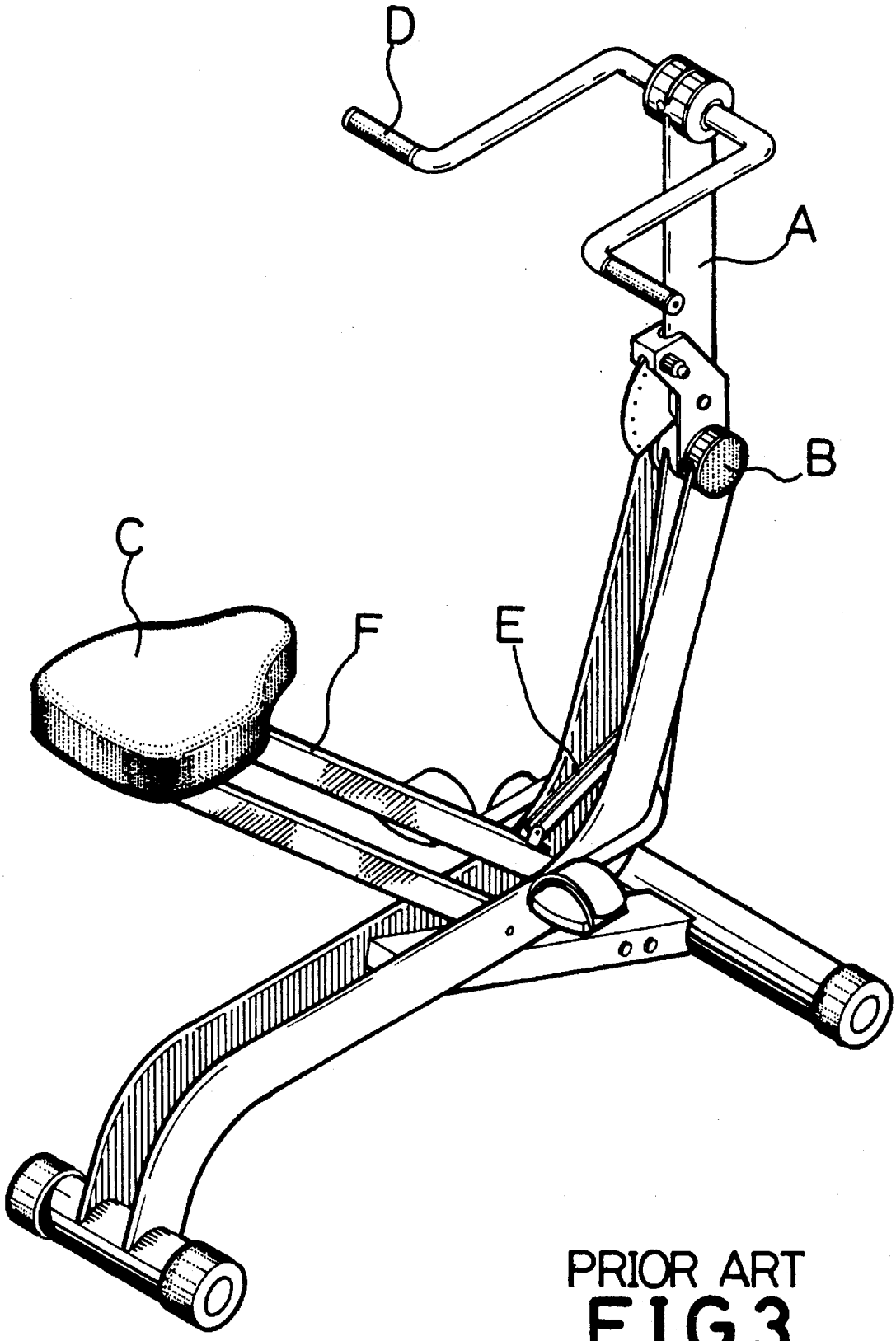
PRIOR ART FIG3
FIG. 3 is a perspective view of a third conventional riding type exercising apparatus.
Figure 4:
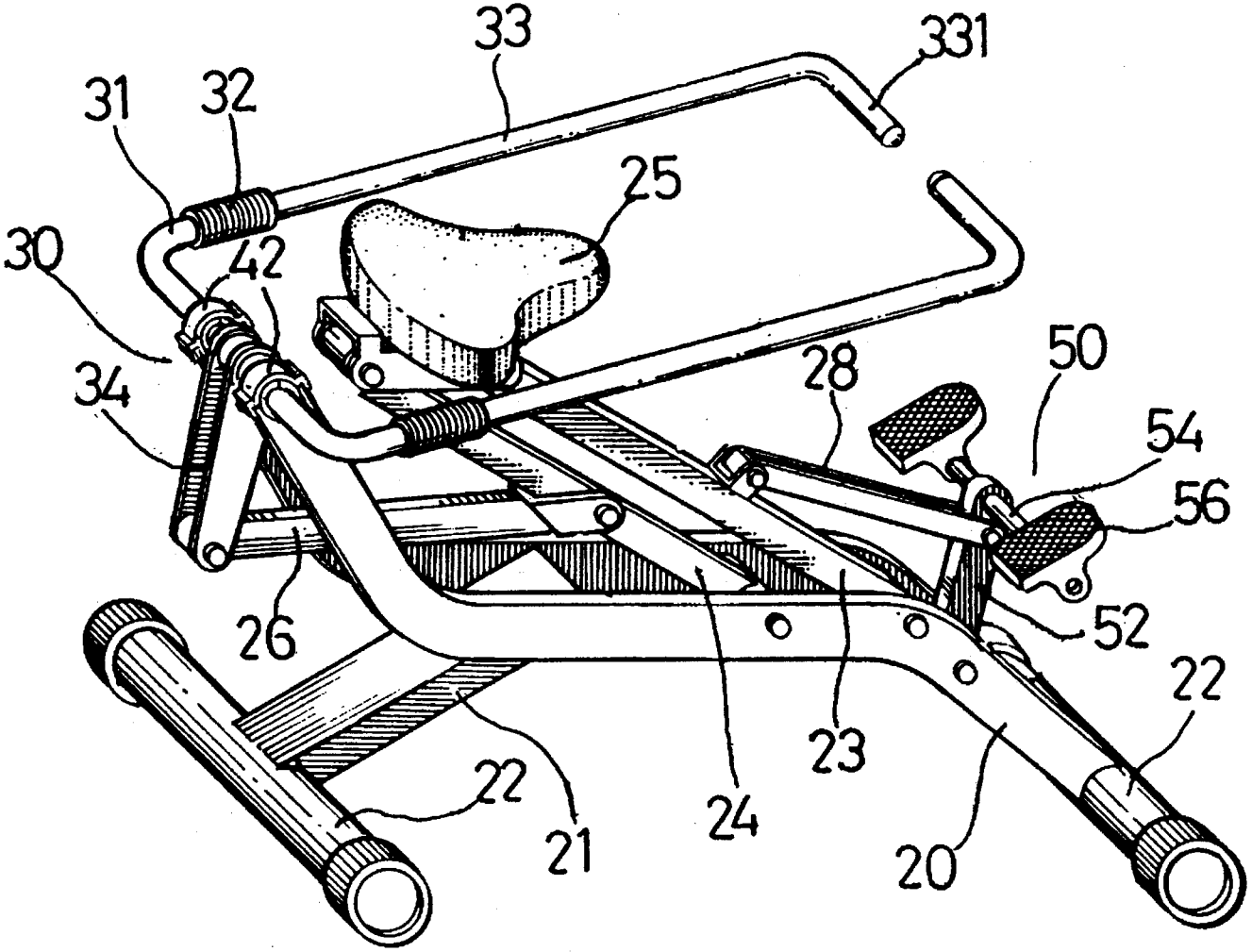
FIG. 4 is a perspective view of the exercising apparatus according to the present invention in an assembled state.

With reference to FIG. 4, the exercising apparatus according to the present invention essentially comprises two parallel curved main frames 20 having a support frame 21 welded to a middle section thereof at a suitable position. Main frames 20 each have a rear end which extends upwardly to form a support post and a front end which extends downwardly to form a front leg member. The exercising apparatus further comprises two horizontal tubes 22, one of which is welded to a lower end of the support frame 21 and the other of which is welded to both front ends of the main frame 20, such that the exercising apparatus is firmly and stably supported on the ground surface. A front seat bar 23 and a rear seat bar 24 are pivotally joined at lower ends thereof to the middle sections of the main frames 20 at suitable positions between the front and rear ends thereof such that the front seat bar 23 and the rear seat bar 24 are disposed parallel and inclined towards the rear of the exercising apparatus. A seat 25 is pivotally fitted onto the upper ends of the front seat bar 23 and the rear seat bar 24. A transmission bar 26 has a front end pivotally joined to a rear side of the rear seat bar 24 and a rear end pivotally connected to a hand driven mechanism 30. Additionally, a transmission bar 28 has a rear end pivotally connected to a front side of the front seat bar 23 and a front end pivotally connected to a leg driven mechanism 50, the latter being pivotally connected to a front lower side of the main frames 20 adjacent the front ends thereof.

The leg driven mechanism 50 includes an upright 52 having a hole in an upper end thereof for insertion of a horizontal rod 54 therethrough. Each end of the horizontal rod 54 is pivotally connected to a pedal 56.

Figure 5:
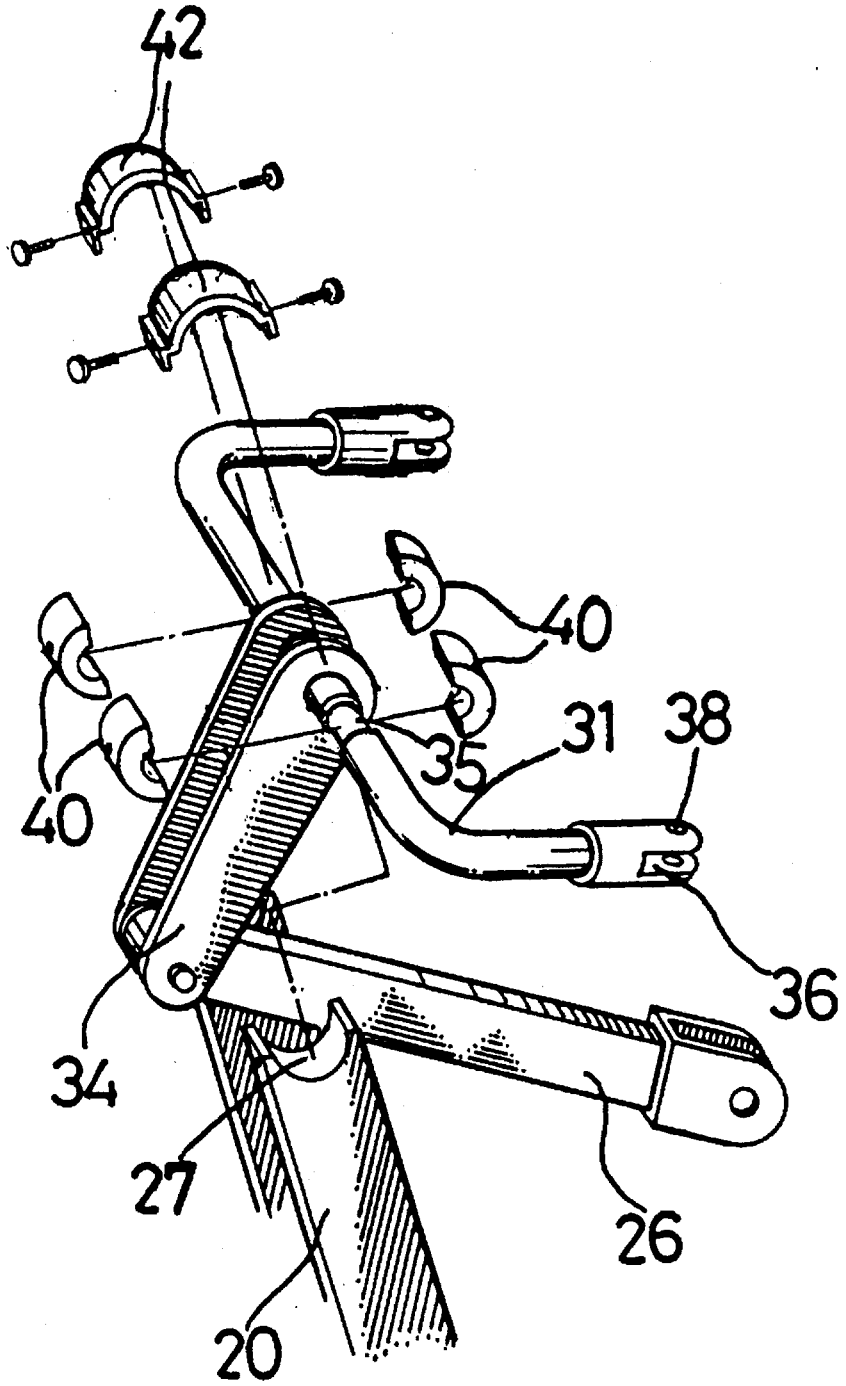
FIG. 5 is an exploded perspective view of a hand drive mechanism of the exercising apparatus of the present invention.
Figure 6:
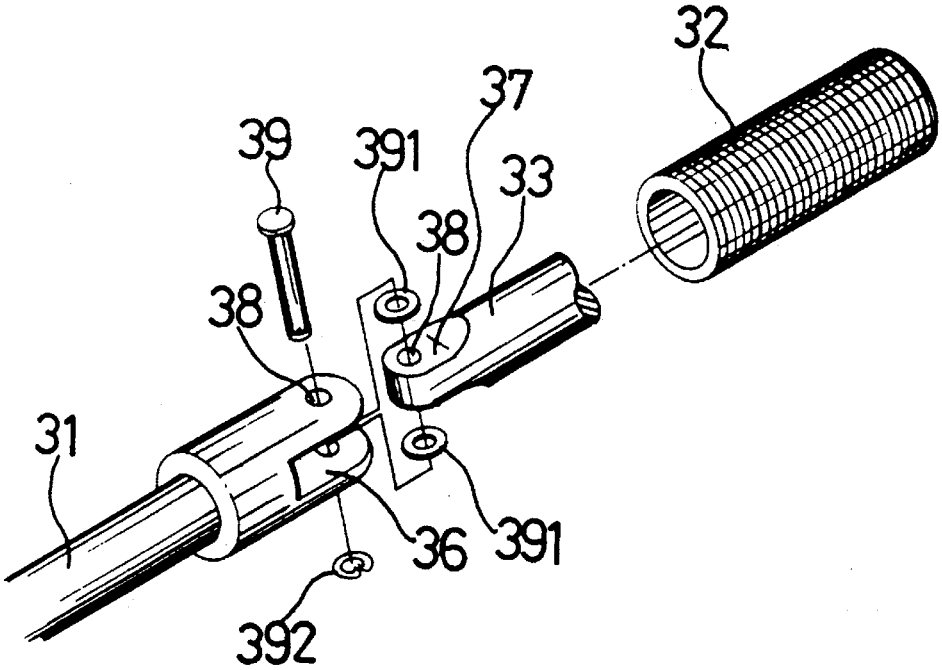
FIG. 6 is an exploded perspective view of the drive arm of the hand drive mechanism.

As shown in FIGS. 5 and 6, which are perspective views of the hand driven mechanism 30, the hand driven mechanism 30 of the present invention consists of a drive arm 31, two elastic plastic sleeves 32 and two handles 33. The drive arm 31 is substantially C-shaped, and a middle section of the drive arm 31 is provided with two linkage members 34 which are spaced apart from each other and extend downwardly. The rear end of transmission bar 26 is pivotally connected between the linkage member 34 at lower ends thereof to permit a linked movement. At the upper ends of the linkage member 34 and on opposite sides thereof are two neck portions 35 formed in drive arm 31. A pair of semicylindrical jackets 40 are wrapped around each neck portion 35, and two semicylindrical positioning elements 42 are screwed on the jackets 40 around the respective neck portions 35 such that each of the neck portions 35 may be pivotally received in a hemispherical recess 27 at the top end of each main frame 20. Furthermore, the two free ends of the drive arm 31 are each provided with a slot element 36 provided with a horizontal slot for receiving an insert portion 37 formed at one end of each handle 33. Each slot element 36 is also provided with opposite holes 38 for receiving a pin 39 therethrough, with pin 39 also extending through a pair of washer rings 39 and a retainer ring 392 for connecting each handle 33 to each free end of the drive arm 31. A plastic sleeve 32 may be tightly fitted around the joint defined by each element 36 and each portion 37 to secure the connection and complete the assembly.

Figure 7:
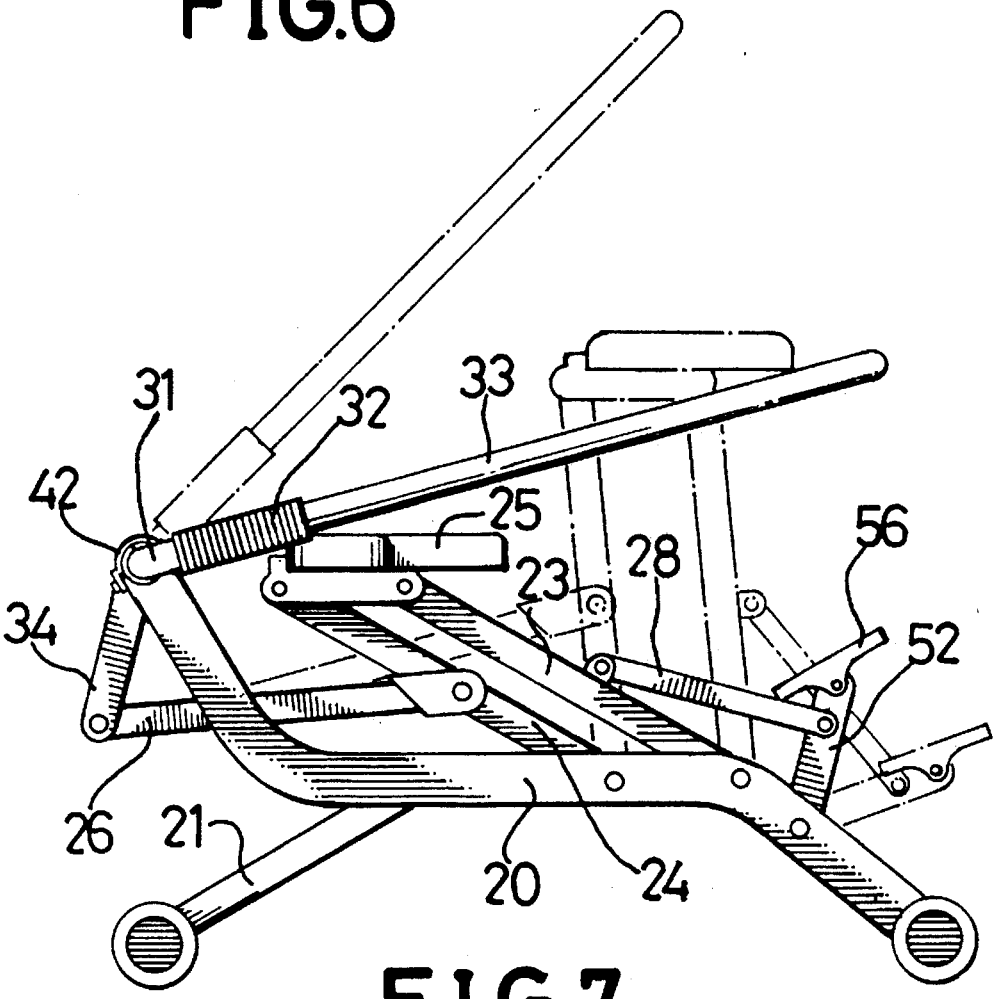
FIG. 7 is a side elevational view illustrating the start and final operational points of the exercising apparatus according to the present invention.

Operation of the assembled exercising apparatus is shown in FIG. 7, in which the solid lines represent the exercising apparatus in a starting position prior to its use. The user sits on the seat 25 with both feet resting on the pedals 56 of the leg driven mechanism 50. The user must incline slightly forward with both hands gripping the grip portions 331 of the handles 33. The user then pushes the pedals 56 in a downward and forward direction both legs and pulls the grip portions 331 backwardly toward the trunk of the user while stretching the body upright. The assembly of the transmission bars 26, 28, the hand driven mechanism 30 and the leg driven mechanism 50 will slowly lift up the front seat bar 23 and the rear seat bar 24, together with the seat 25 and shift the latter towards the front of the exercising apparatus, as shown by the phantom lines in FIG. 7. When the user relaxes, all of the mechanisms and components return to their original starting position.

Since the pivot point of the hand drive mechanism 30 is located behind the user's body and handles 33 extend from the rear upper end of the apparatus at the hand driven mechanism 30, past the seat 25 and toward the front end of the apparatus, when the handles 33 are lifted towards the rear of the exercising apparatus, the seat 25 is gradually and simultaneously lifted up and moved towards the front of the exercising apparatus. It can thus be seen that the handles 33 and the seat 25 move in opposite directions. Furthermore, when the exercising apparatus of the present invention is in a normal state, the grip portions 331 are located at a lower point relative to the pivot point of mechanism 30. When the grip portions 331 are pulled to a final point of operation, they are located at a higher point relative to this pivot point. Therefore, when the grip portions 331 undergo an arcuate displacement with the pivot point as the center of a circle, their final point of operation is definitely higher than the starting point. Thus, the user's hands are able to pull through a large distance during exercising, without the disadvantage in the prior art in which the distance between the lowest and highest point of movement becomes restricted by the upward elevation of the seat 25. In other words, the user may not only stretch the legs sufficiently, but also stretch, swing and expand the arms sufficiently as in rowing to achieve optimum exercising benefits.

In addition, the arrangement of the horizontal pivot connection of the drive arm 31 and the handles 33 of the hand driven mechanism 30 permits the natural bending of the elbows so that the user may stretch the arms naturally outwardly. Such an ergonomic structural arrangement enhances user comfort during exercising. Besides, the plastic sleeves 32 provided on the joints between the drive arm 31 and the handles 33 have a strong restoring function to ensure the return of the handles 33 to their normal positions when all outside forces are absent.

Although the present invention has been illustrated and described with reference to the preferred embodiment thereof, it should be understood that it is in no way limited to the details of such embodiment but is capable of numerous modifications within the scope of the appended claims.

We claim:

1. A riding type exercising apparatus comprising:

a) a pair of parallel main frames, each main frame having a rear end extending upwardly for forming a support post and a front end extending downwardly for forming a front leg member;

b) a support frame including an upper end and a lower end, the upper end of the support frame being secured to the main frames between the upper and lower ends of the main frames;

c) a pair of horizontal tubes for supporting the apparatus on a ground surface, one horizontal tube being secured to the lower end of the support frame and the other horizontal tube being secured to the front leg member of the main frames;

d) a front seat bar and a rear seat bar disposed in parallel, each seat bar including an upper end and a lower end, the lower ends of the seat bars being pivotally connected to the mainframes between the upper and lower ends of the main frames, the seat bars being inclined upwardly towards the rear end of the main frames;

e) a seat pivotally connected to the upper ends of the seat bars;

f) a first transmission bar including a front end and a rear end, the front end being pivotally connected to the rear seat bar between the upper and lower ends of the rear seat bar;

g) a hand driven mechanism pivotally supported on the support posts of the main frames and pivotally connected to the rear end of the first transmission bar, the hand driven mechanism including a pair of handles extending from the hand driven mechanism past the seat and toward the front ends of the main frames, each handle terminating in a grip for engagement by the hands of a user, the grips being positioned forwardly of the seat when the apparatus is not being used;

h) a second transmission bar including a front end and a rear end, the rear end being pivotally connected to the front seat bar between the upper and lower ends of the front seat bar;

i) a leg driven mechanism pivotally mounted to the main frames adjacent the front ends thereof, the front end of the second transmission bar being pivotally connected to the leg driven mechanism, and a pair of pedals mounted on the leg driven mechanism for engagement by the feet of a user; and j) wherein when a user sits on the seat, pushes the pedals in a downward and forward direction, and pulls the handles in an upward and rearward direction, the grips undergo an arcuate displacement about the center of a circle defined by the pivotal support of the hand driven mechanism to simultaneously move the handles rearwardly and the seat upwardly and forwardly in opposite directions for providing unrestricted arm movements by the user during exercising.

2. The exercising apparatus of claim 1 wherein the hand driven mechanism further includes:

a) a C-shaped drive arm including a pair of free ends, each handle being pivotally connected to a free end of the drive arm;

b) a pair of linkage members, each linkage member including an upper end and a lower end, the drive arm being pivotally connected to the upper ends of the linkage members, the rear end of the first transmission bar being pivotally connected to the lower ends of the linkage members; and c) the drive arm including a pair of neck portions on opposite sides of the linkage members, a pair of jackets secured to each neck member, a hemispherical recess formed at the support post of each main frame, and the pairs of jackets being pivotally engaged within the hemispherical recesses.

3. The exercising apparatus of claim 2 wherein:

a) each free end of the drive arm includes a horizontal slot formed therein;

b) each handle including an insert portion, the insert portions being pivotally engaged within the horizontal slots for forming a pair of pivot joints; and c) an elastic plastic sleeve surrounding each pivot joint.

4. The exercising apparatus of claim 1 wherein the leg driven mechanism further includes:

a) an upright member including an upper end and lower end;

b) the lower end of the upright member being pivotally connected to the main frames and the front end of the second transmission bar being pivotally connected to the upright member between the upper and lower ends of the upright member; and c) a horizontal rod extending through the upper end of the upright member and the pair of pedals being mounted on the horizontal rod.

* * * * *